US005997352A

United States Patent [19]

Newport et al.

[11] Patent Number: 5,997,352

[45] Date of Patent: Dec. 7, 1999

[54] STRUCTURE FOR RETAINING FRONT HOLDER IN HOUSING

[75] Inventors: John James Newport, Armagh, United Kingdom; Hisashi Hanazaki, Canton, Mich.

[73] Assignee: Yazaki Corporation, Tokyo, Japan

[21] Appl. No.: 09/008,547

[22] Filed: Jan. 16, 1998

[30] Foreign Application Priority Data

Jan. 17, 1997 [JP] Japan ..... 9-006523

[51] Int. Cl.[6] ..... H01R 13/40

[52] U.S. Cl. ..... 439/595

[58] Field of Search ..... 439/595

[56] References Cited

U.S. PATENT DOCUMENTS

| | | | |
|---|---|---|---|
| 5,597,325 | 1/1997 | Maejima et al. | 439/595 |
| 5,782,658 | 7/1998 | Maegawa et al. | 439/595 |

FOREIGN PATENT DOCUMENTS

| | | | |
|---|---|---|---|
| 196 22 805 | 12/1996 | Germany | H01R 13/436 |
| 2 281 453 | 3/1995 | United Kingdom | H01R 13/436 |

*Primary Examiner*—Renee S. Luebke
*Assistant Examiner*—Vincent Johnson
*Attorney, Agent, or Firm*—Sughrue, Mion, Zinn, Macpeak & Seas, PLLC

[57] ABSTRACT

A connector includes a housing and a front holder. The housing includes a terminal receiving chamber formed therein, the terminal receiving chamber being receivable a terminal therein, the terminal receiving chamber including a flexible retaining lance which is arranged to extend from an inner wall of the terminal receiving chamber, the retaining lance being preventable the terminal coming off while retaining the terminal, and a refuge space formed under the retaining lance. The front holder includes a main body portion and a flexion preventing portion preventable a flexion of the retaining lance by entering into the refuge space, the flexion preventing portion being arranged to extend from the main body portion, the front holder is insertable into the housing from a surface of the housing engageable with a mating connector so as to be retained in the housing. When the front holder is in a regularly retained position with respect to the housing, the flexion preventing portion is inserted into the refuge space to regulate the flexion of the retaining lance. On the other hand, when the front holder is in a temporarily retained position with respect to the housing, the flexion preventing portion is evacuated from the refuge space to allow the flexion of the retaining lance. Inclination preventing portions are arranged on the main-body portion, the inclination preventing portions regulate an inclination of the front holder in the temporarily retained position with respect to the housing so as to prevent an entrance of flexion preventing portion into the refuge space.

7 Claims, 4 Drawing Sheets

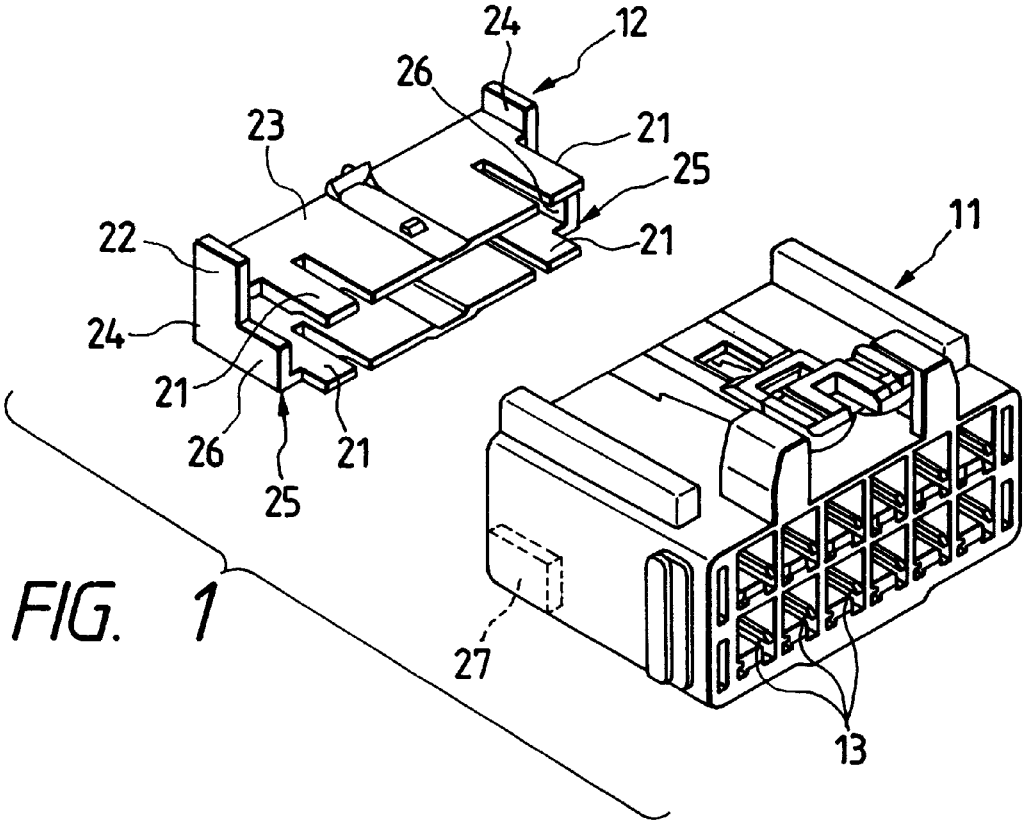
FIG. 1
FIG. 2
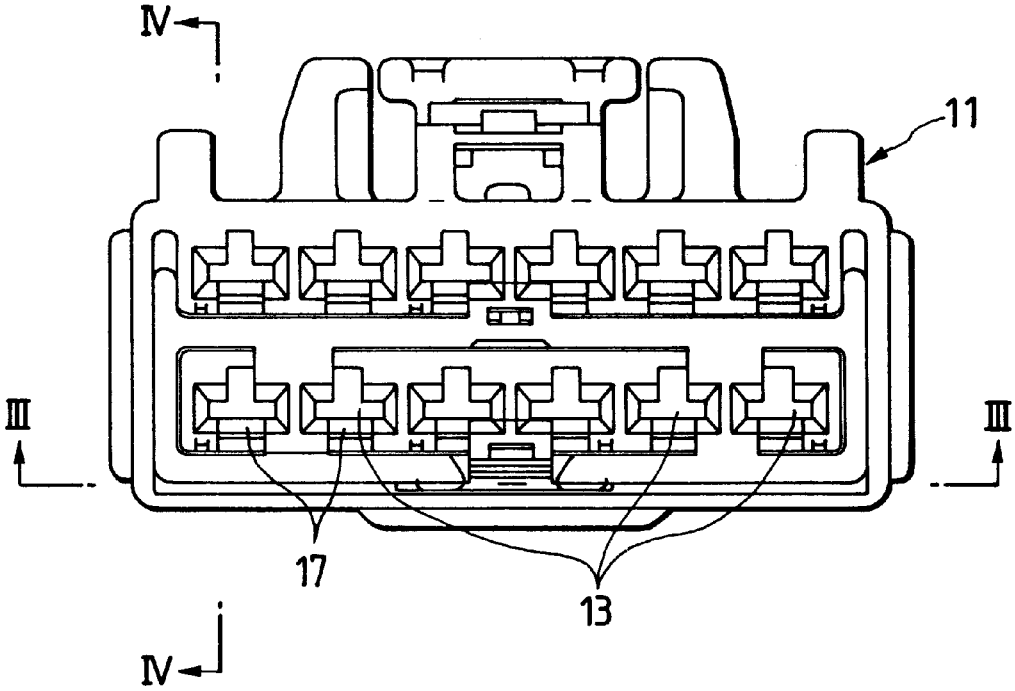

STRUCTURE FOR RETAINING FRONT HOLDER IN HOUSING

BACKGROUND OF THE INVENTION

1. Field of the Invention

This invention relates to a structure for retaining a front holder in a housing. The structure allows the front holder for preventing a terminal coming off to be retained in the housing while the front holder is inserted into the housing from an engagement surface side of the housing.

2. Background

FIG. 6 is a perspective view showing a conventional doubly retained connector which includes a housing and a front holder; FIG. 7 is a sectional view showing a condition in which the front holder is inclined in the housing; and FIG. 8 is a sectional view showing a relation between a flexion preventing plate portion and a refuge space in the condition in which the front holder is inclined in the housing.

A doubly retained connector 1 shown in FIG. 6 has been disclosed in Unexamined Japanese Patent Publication No. Hei. 8-203592. The connector 1 includes a housing 2 having a plurality of terminal receiving chambers 4 which are respectively receivable terminals therein, and a front holder 3 which is retained in the housing 2 from an engagement surface 2*a* side of the housing 2.

As shown in FIG. 8, flexible retaining lances 5 extend from an inner wall of the terminal receiving chambers 4, respectively. The retaining lances 5 have retaining stepped portions 6. The retaining stepped portions 6 respectively retain the terminals 7 received in the terminal receiving chambers 4, so as to prevent terminals 7 coming off from the terminal receiving chambers 4.

The front holder 3 includes a frame-forming main-body portion 8 and a plurality of flexion preventing plates 9 formed integrally with the frame-forming main-body portion 8 so as to project from the frame-forming main-body portion 8. The front holder 3 is inserted into the housing 2 from the engagement surface 2*a* of the housing 2 engageable with a mating connector. Furthermore, the front holder 3 is retained by the housing 2 at two positions, a regularly retained position and a temporarily retained position, with respect to the housing 2.

When the front holder 3 is in the regularly retained position, the flexion preventing plates 9 are respectively inserted into refuge spaces 10 under the retaining lances 5 in the terminal receiving chambers 4. Accordingly, inadvertent flexion of the retaining lances 5 can be prevented, and also the terminals 7 are doubly retained within the terminal receiving chambers 4.

On the other hand, when the front holder 3 is in the temporarily retained position, the flexion preventing plates 9 are evacuated from the refuge spaces 10 under the retaining lances 5 in the terminal receiving chambers 4. Under this condition, if a terminal 7 is inserted into a terminal receiving chamber 4, the corresponding retaining lance 5 flexes. When the terminal 7 is further inserted to be accommodated at a predetermined position within the terminal receiving chamber 4, the retaining lance 5 returns to the original shape by its own resiliency to thereby cause the retaining stepped portion 6 of the retaining lance 5 to be retained by the terminal 7.

On the other hand, in order to pull a terminal 7 out of a terminal receiving chamber 4, the retaining lance 5 can be forcibly flexed by a terminal releasing jig after moving the front holder 3 from the regularly retained position to the temporarily retained position. Accordingly, the terminal 7 can be pulled out of the terminal receiving chamber 4.

However, when the front holder 3 is in the temporarily retained position with respect to the housing 2, the front holder 3 may be inclined with respect to the housing 2 due to play in a direction of width as shown in FIG. 7. When the front holder 3 is inclined, one side of the width direction of the front holder 3 may be inserted unnecessarily into the housing 2. Accordingly, end portions of the flexion preventing plates 9 are undesirably inserted into the refuge spaces 10 of the retaining lances 5 as shown in FIG. 8. Since the retaining lances 5 are not allowed to flex under this condition, the problem that a terminal 7 cannot be inserted into a terminal receiving chamber 4 arises.

Furthermore, even if attempts are made to forcibly flex a retaining lance 5 by inserting the terminal releasing jig, the flexion preventing plates 9 regulate flexion of the retaining lance 5. From this arises the problem that the terminal 7 cannot be pulled out even if the front holder 3 is set in the temporarily retained position.

SUMMARY OF THE INVENTION

The object of the invention is to provide a structure for retaining a front holder in a housing in which the flexion preventing plates are prevented from being inadvertently inserted into the refuge spaces of the retaining lances by checking the front holder in the temporarily retained position from playing with respect to the housing.

The above object of this invention has been achieved by a structure for retaining a front holder in a housing, which includes: a housing including a flexible retaining lance arranged so as to extend from an inner wall of a terminal receiving chamber for receiving a terminal therein, the retaining lance serving to prevent the terminal coming off from the terminal receiving chamber while retaining the terminal; and a front holder including a flexion preventing plate portion arranged integrally so as to project from a frame-forming main-body portion and being retained by the housing from a surface of the housing engageable with a mating connector. In the structure for retaining the front holder in the housing, when the front holder is in a regularly retained position with respect to the housing, the flexion preventing plate portion is inserted into a refuge space formed under the retaining lance so as to prevent a possible flexion of the retaining lance to thereby doubly retain the terminal in the terminal receiving chamber, and further, when the front holder is in a temporarily retained position with respect to the housing, the flexion preventing plate portion is evacuated from the refuge space of the retaining lance to thereby allow the terminal to be inserted into the terminal receiving chamber. In such structure for retaining the front holder in the housing, an inclination preventing portion is arranged on the frame-forming main-body portion. The inclination preventing portion serves to block a possible entrance of the flexion preventing plate portion into the refuge space by checking the front holder in the temporarily retained position from playing with respect to the housing.

In the structure for retaining the front holder in the housing, the inclination preventing portion checks the front holder in the temporarily retained position from being inclined with respect to the housing. Therefore, there is no possibility that the front holder will be inserted into the refuge space of the retaining lance inadvertently. Accordingly, when the front holder is in the temporarily retained position, a terminal can be inserted into and accommodated in a terminal receiving chamber reliably, and further the terminal can be pulled out of the terminal receiving chamber reliably by forcibly flexing the retaining lance.

Further, the inclination preventing portions are arranged on both side portions in the width direction of the frame-forming main-body portion. Furthermore, the inclination preventing portions are extended portions to be inserted into guide groove portions arranged on both sides in the width direction of the housing.

In this structure for retaining the front holder in the housing, the inclination preventing portions are arranged on both sides in the width direction of the frame-forming main-body portion and are inserted into the guide groove portions of the housing. Therefore, the front holder in the temporarily retained position is checked from playing with respect to the housing.

Furthermore, the frame-forming main-body portion includes a coupling plate portion and a frame plate portion, the coupling plate portion coupling a plurality of flexion preventing plate portions parallelly, the frame plate portion being disposed on both sides of the coupling plate portion so as to be orthogonal to the coupling plate portion; and the extended portions extend from the frame plate portion in the same direction as the flexion preventing plate portions.

In this structure for retaining the front holder in the housing, the flexion preventing plate portions are inserted into the terminal receiving chambers, and further, the extended portions are inserted into the guide groove portions of the housing when the front holder is inserted into the housing from the engagement surface side of the housing.

Still further, when the front holder is in the temporarily retained position with respect to the housing, the extended portions restrict the playing of the front holder with respect to the housing. Therefore, there is no possibility that the flexion preventing plate portions will be inserted into the refuge spaces of the retaining lances inadvertently.

BRIEF DESCRIPTION OF THE DRAWINGS

FIG. 1 is a perspective view showing a housing and a front holder to which a structure for retaining a front holder in a housing of the invention is applied;

FIG. 2 is a front view showing the housing;

DETAILED DESCRIPTION OF THE PREFERRED EMBODIMENTS

Figure 3:
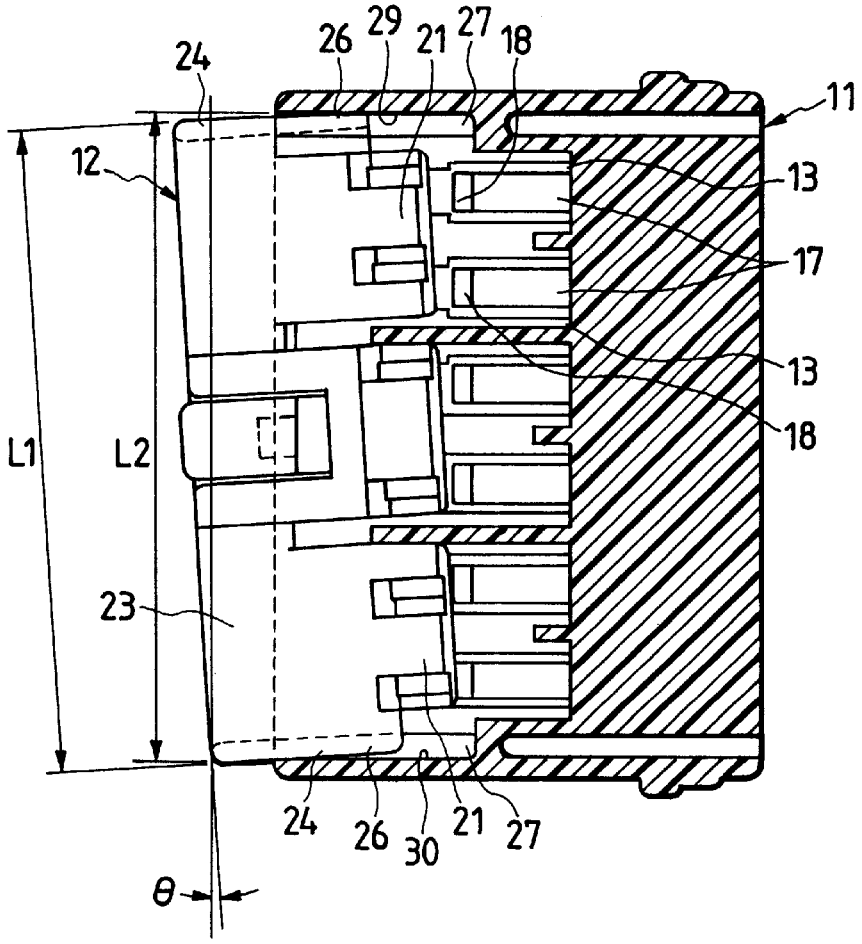
FIG. 3 is a sectional view taken along a line III—III of FIG. 2.
Figure 4:
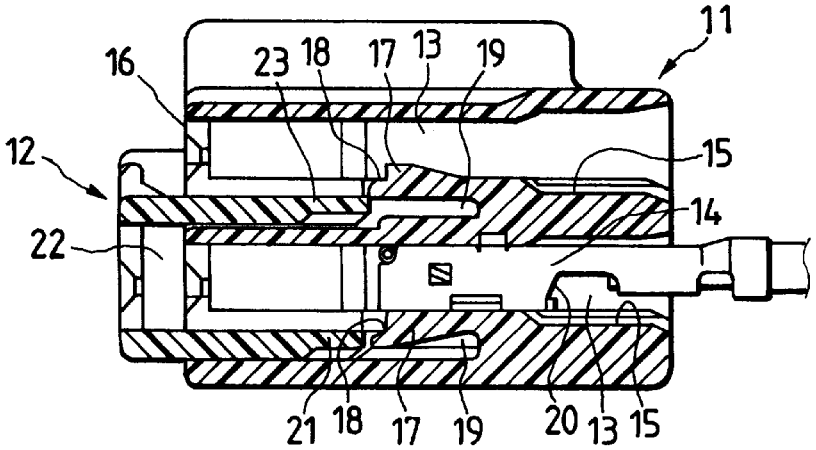
FIG. 4 is a sectional view taken along a line IV—IV of FIG. 2.

A structure for retaining a front holder in a housing, which is a mode for carrying out the invention, will now be described. FIG. 1 is a perspective view showing a housing 11, to which the invention is applied, and a front holder 12 that is to be fitted into the housing 11 from an engagement surface side of the housing 11; and FIG. 2 is a front view of the housing 11. Further, FIG. 3 is a sectional view taken along a line III—III of FIG. 2; and FIG. 4 is a sectional view taken along a line IV—IV of FIG. 2.

The housing 11 has terminal receiving chambers 13 of two stories therein. Each terminal receiving chamber 13 passes through both ends of the housing 11 in an axial direction (in a direction of engagement with a mating connector). The terminal receiving chambers 13 receive terminals 14, respectively. As shown in FIG. 4, a flexible retaining lance 17 is arranged so as to project from an inner wall 15 of each terminal receiving chamber 13 toward a surface 16 engageable with the terminal. A retaining stepped portion 18 is formed on the distal end of the retaining lance 17. A refuge space 19 is formed between the retaining lance 17 and the inner wall 15 of the terminal receiving chamber 13.

The retaining stepped portion 18 retains a retaining shoulder 20 of a terminal 14 accommodated in the terminal receiving chamber 13 so as to prevent the terminal 14 being inadvertently removed from the terminal receiving chamber 13. At this time, the retaining lance 17 is not flexed, so that the refuge space 19 is open. By inserting flexion preventing plates 21 of the front holder 12 into these refuge spaces 19, inadvertent flexion of the retaining lance 17 is blocked.

The front holder 12 includes a frame-forming main-body portion 22 and the flexion preventing plate portions 21 projecting from the frame-forming main-body portion 22. The frame-forming main-body portion 22 is formed so as to be rectangular in shape by coupling plate portions 23 and frame plate portions 24. Each coupling plate portion 23 couples the flexion preventing plate portions 21 in a parallel manner. The frame plate portions 24 are formed on both sides of the coupling plate portions 23 so as to be orthogonal to the coupling plate portions 23.

When the front holder 12 is set in a regularly retained position with respect to the housing 11, the front holder 12 regulates flexion of the retaining lance 17 because the flexion preventing plate portions 21 of the front holder 12 enter into the refuge spaces 19. Accordingly, when the front holder 12 is in the regularly retained position, the terminal 14 accommodated in the terminal receiving chamber 13 is doubly retained in the terminal receiving chamber 13 such that the retaining stepped portion 18 of the retaining lance 17 retain the terminal 14, and inadvertent flexion of the retaining lance 17 is regulated by the flexion preventing plate portion 21.

On the other hand, when the front holder 12 is set in a temporarily retained position with respect to the housing 11, the flexion preventing plate portions 21 are evacuated from the refuge spaces 19 of the retaining lances 17. Under this condition, the retaining lances 17 can flex. Therefore, the terminal 14 is allowed to be inserted into the terminal receiving chamber 13. Of course, if the terminal 14 is accommodated in the terminal receiving chamber 13, the retaining lances 17 prevent the terminal 14 from being removed from the terminal receiving chamber 13 with the retaining stepped portion 18 retaining the retaining shoulder 20 of the terminal 14. However, in this case, by forcibly flexing the retaining lance 17 using a terminal releasing jig, the terminal 14 can be pulled out of the terminal receiving chamber 13.

Furthermore, the front holder 12 includes inclination preventing portions 25 formed on the frame-forming main-body portion 22 thereof. When the front holder 12 is in the temporarily retained position with respect to the housing 11, the inclination preventing portions 25 prevent an inclination of the front holder 12 so that the flexion preventing plate portions 21 cannot enter into the refuge spaces 19. Further, the inclination preventing portions 25 are extended portions 26 extending from the frame plate portions 24 in the same direction as the flexible preventing plate portions 21.

Each extended portion 26 is formed in such a manner that the lower half of the corresponding frame plate portion 24 is projected in the same direction as the flexion preventing plate portions 21, and is inserted into a guide groove portion (see FIG. 3) 27 formed in each of both sides across the width of the housing 11.

As shown in FIG. 3, if the extended portions 26 are inserted into the guide groove portions 27 of the housing 11, and further, the front holder 12 is inclined with respect to the housing 11, the front end portion of one of the extended portions 26 abuts against the depth of the inner wall 29 of one of the guide groove portions 27, and the rear side of the other extended portion 26 abuts against the opening side of the inner wall 30 of the other guide groove portion 27.

Figure 7:
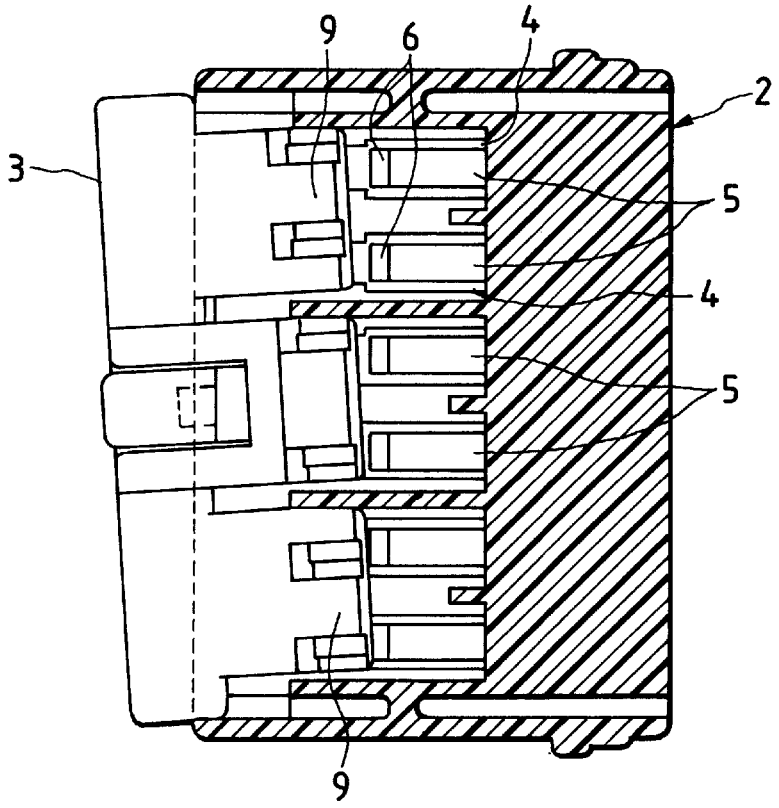
FIG. 7 PRIOR ART
FIG. 7 is a sectional view showing a condition in which the front holder is inclined in the housing.
Figure 8:
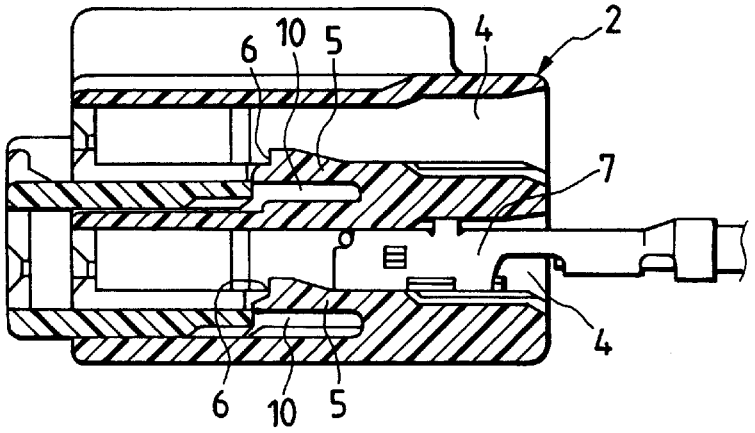
FIG. 8 PRIOR ART
FIG. 8 is a sectional view showing a relation between a flexion preventing plate portion and a refuge space in the condition in which the front holder is inclined in the housing.

In this case, if the extended portions 26 are absent as shown in FIG. 7, an angle θ of an inclination of the front holder 12 with respect to the housing 11 is increased, so that the flexion preventing plate portions 21 on the other side do enter into the refuge spaces 19. However, if the extended portions 26 are present, an angle θ of an inclination of the front holder 12 with respect to the housing 11 is decreased, so that the flexion preventing plate portions 21 on the other side cannot enter deep into the housing 11, precluding the possibility that the flexion preventing plate portions 21 will enter into the refuge spaces 19. Since the playing (at the angle θ of inclination) of the front holder 12 with respect to the housing 11 can be restricted by arranging the extended portions 26, there is no possibility that the flexion preventing plate portions 21 will enter into the refuge spaces 19 inadvertently.

As shown in FIG. 3, the width L1 of the front holder 12 is set to a value smaller than the distance L2 between the guide groove portions 27, 27 of the housing 11. Therefore, the dimensions are set so that at least the extended portions 26 and the frame plate portions 24 can be inserted into the guide groove portions 27 smoothly.

Then, an operation of this mode for carrying out the invention will be described.

First, the front holder 12 is attached to the housing 11. In this case, the front holder 12 is inserted into the housing 11 from the engagement surface 16 side of the housing 11, and is retained in the temporarily retained position. Since the extended portions 26 of the front holder 12 are inserted into the guide groove portions 27 under this condition, the front holder 12 is checked from playing with respect to the housing 11. In addition, there is no possibility that the flexion preventing plate portions 21 of the front holder 12 will enter into the flexible places 19 inadvertently.

When a terminal 14 is inserted into a terminal receiving chamber 13 under this condition, first, the front end portion of the terminal 14 abuts against the retaining lance 14. When the terminal 14 is further moved toward the depth of the terminal receiving chamber 13, the retaining lance 17 flexes toward the refuge space 19. When the terminal 14 is inserted up to a predetermined position in the terminal receiving chamber 13, the retaining lance 17 returns to the original position by its own resiliency to thereby cause the retaining stepped portion 18 to be retained by the retaining shoulder 20 of the terminal 14. As a result, a possible release of the terminal 14 from the terminal receiving chamber 13 is blocked.

Even if the front holder 12 gets inclined with respect to the housing 11 at this instance, there is no possibility that the flexion preventing plate portions 21 will enter into the refuge spaces 19 inadvertently, since the extended portions 26 restrict the playing of the front holder 12. Accordingly, the terminal 14 can be inserted into and accommodated in the terminal receiving chamber 13 reliably.

Then, when the front holder 12 is inserted into the housing so as to be set in the regularly retained position with respect to the housing 11, the flexion preventing plate portions 21 of the front holder 12 are inserted into the refuge spaces 19. Accordingly, inadvertent flexion of the retaining lance 17 is regulated, and the terminal 14 is doubly retained in the terminal receiving chamber 13.

Further, in order to release the terminal 14 accommodated in the terminal receiving chamber 13 in the regularly retained position from the terminal receiving chamber 13, firstly, the front holder 12 is pulled out of the housing 11 up to the temporarily retained position so that the flexion preventing plate portions 21 are released out of the refuge spaces 19.

By forcibly flexing the retaining lance 17 while inserting the terminal releasing jig (not shown) into the terminal receiving chamber 13 under this condition, the retainment of the retaining stepped portion 18 by the retaining shoulder 20 is released. By directly pulling the terminal 14 out, the terminal 14 can be taken out of the terminal receiving chamber 13.

In this case, since the extended portions 26 check the front holder 12 set in the temporarily retained position from playing with respect to the housing 11, there is no possibility that the flexion preventing plate portions 21 will enter into the refuge spaces 19 inadvertently even if the front holder 12 gets inclined with respect to the housing 11. Therefore, by setting the front holder 12 in the temporarily retained position with respect to the housing 11, the terminal 14 can be pulled out of the terminal receiving chamber 13 reliably.

According to the structure for retaining the front holder 12 in the housing 11, the front holder 12 is provided with the extended portions 26 that are to be inserted into the guide groove portions 27 of the housing 11. As a result of this construction, the front holder 12 set in the temporarily retained position can be prevented from playing with respect to the housing 11, which in turn excludes the possibility that the flexion preventing plate portions 21 will enter into the refuge spaces 19 of the retaining lances 17 inadvertently.

Figure 5:
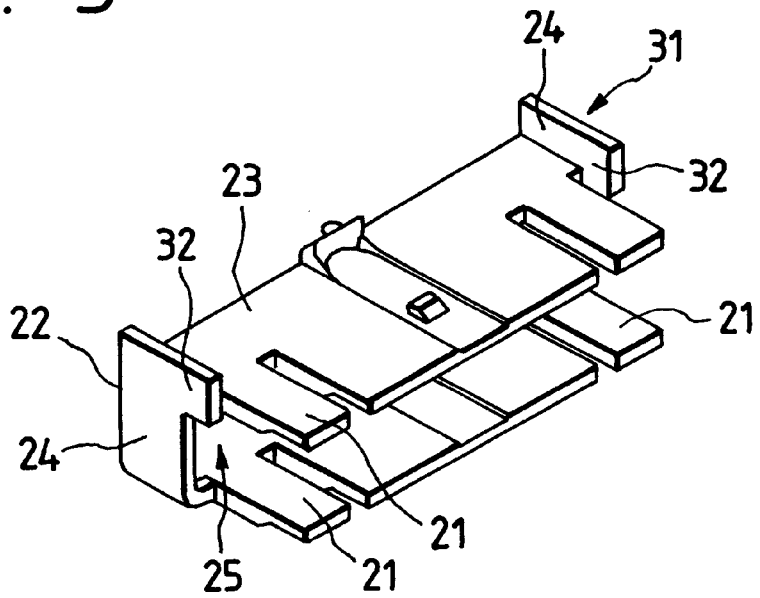
FIG. 5 is a perspective view showing another mode of the front holder.
Figure 6:
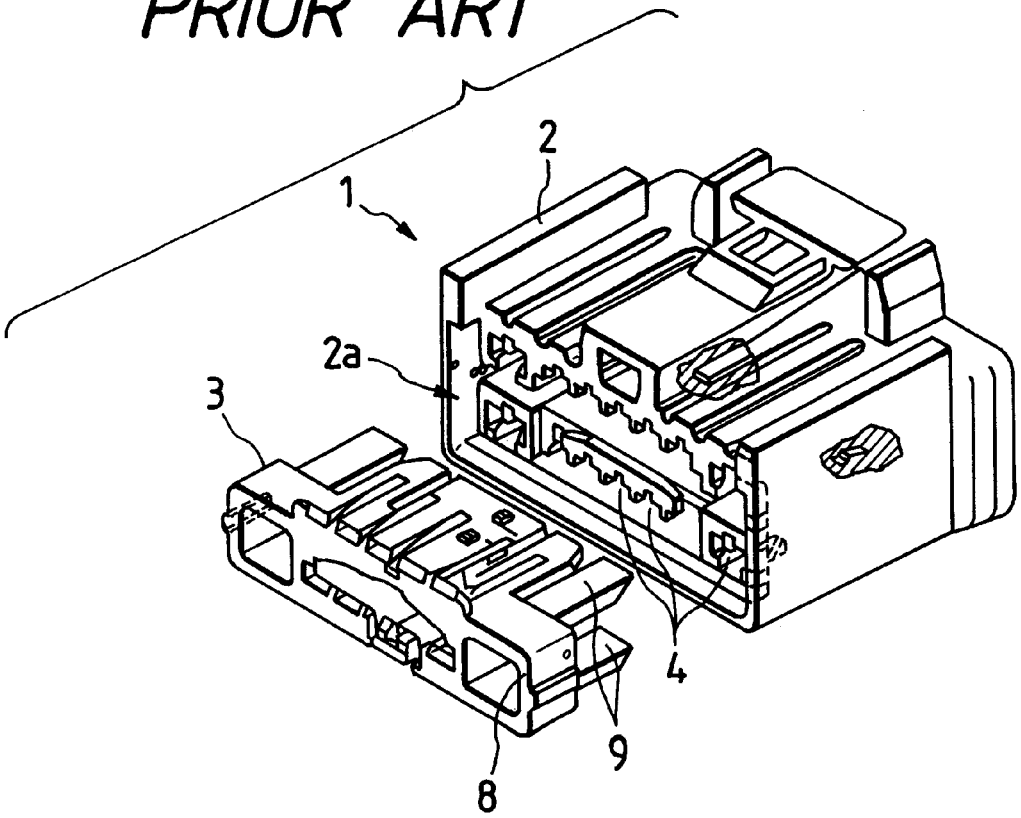
FIG. 6 PRIOR ART
FIG. 6 is a perspective view showing a conventional doubly retained connector which includes a housing and a front holder.

In the meantime, as shown in FIG. 5, a front holder 31 may be constructed in such a manner that the upper half of each frame plate portion 24 of the front holder 31 is extended to form extended portions 32 so as to project in the same direction as the flexion preventing plate portions 21. In this case, the guide groove portions are arranged in the upper half portions on both sides in the width direction of the housing.

What is claimed is:

1. A connector, comprising:

a housing;

a terminal receiving chamber formed in the housing for receiving a terminal therein, said terminal receiving chamber including a flexible retaining lance which is arranged to extend from an inner wall of the terminal receiving chamber, the retaining lance retaining the terminal in the terminal receiving chamber, and a refuge space formed closely to the retaining lance;

a front holder including a main body frame portion and a flexion preventing portion preventing a flexion of the retaining lance by entering into the refuge space, the flexion preventing portion being arranged to extend from the main body frame portion, the front holder being insertable into the housing from a surface of the housing engageable with a mating connector so as to be retained in the housing, wherein when the front holder is in a temporarily retained position with respect to the housing, the flexion preventing portion is evacuated from the refuge space to allow the flexion of the retaining lance; and inclination preventing portions arranged on the main body frame portion and extending forwardly therefrom, the inclination preventing portions minimizing an inclination of the front holder in the temporarily retained position with respect to the housing so as to prevent an entrance of flexion preventing portion into the refuge space, said inclination being regulated in a lateral direction extending perpendicular to said terminal receiving chamber.

2. The connector of claim 1, wherein the inclination preventing portions are respectively arranged on both sides in the width direction of the main body frame portion.

3. The connector of claim 1, further comprising guide groove portions arranged on both sides in the width direction of the housing, wherein the inclination preventing portions are extended to be inserted into the guide groove portions.

4. The connector of claim 3, wherein the inclination preventing portions are extended portions to be inserted into the guide groove portions.

5. The connector of claim 4, further comprising a coupling plate portion coupling a plurality of the flexion preventing portions parallelly, and frame plate portions disposed on both sides of the coupling plate portion so as to be orthogonal to the coupling plate portion, wherein the extended portions extend from the frame plate portions in the same direction as the flexion preventing portions.

6. The connector of claim 1, further comprising a coupling plate portion coupling a plurality of the flexion preventing portions parallelly, and frame plate portions disposed on both sides of the coupling plate portion so as to be orthogonal to the coupling plate portion.

7. The connector of claim 1, wherein when the front holder is in a regularly retained position with respect to the housing, the flexion preventing portion is inserted into the refuge space to regulate the flexion of the retaining lance.

* * * * *